United States Patent [19]

Balston

[11] 3,973,511

[45] Aug. 10, 1976

[54] BOLLARD

[75] Inventor: John C. Balston, San Rafael, Calif.

[73] Assignee: The Rucker Company, Oakland, Calif.

[22] Filed: July 21, 1975

[21] Appl. No.: 597,539

[52] U.S. Cl. ..... 114/218

[51] Int. Cl.[2] ..... B63B 21/06

[58] Field of Search..... 114/218, 230, 235 R, 114/235 A, 217; 24/115 R, 115 C, 115 F, 115 K; 294/84

[56] References Cited

UNITED STATES PATENTS

| | | | |
|---|---|---|---|
| 1,141,807 | 6/1915 | Lucia | 114/218 |
| 2,990,801 | 7/1961 | Ash | 114/218 |
| 3,812,811 | 5/1974 | Rodriguez | 114/218 |

FOREIGN PATENTS OR APPLICATIONS

| | | | |
|---|---|---|---|
| 790,078 | 2/1958 | United Kingdom | 114/235 A |

*Primary Examiner*—Trygve M. Blix
*Assistant Examiner*—Charles E. Frankfort
*Attorney, Agent, or Firm*—Lothrop & West

[57] ABSTRACT

A device for handling a line or rope includes a fixed base. A release lever is horizontally pivoted at one end to the base. An upright bollard drum is, in turn, horizontally pivoted at the bottom to the release lever for restricted movement toward and away from upstanding pads on the release lever so as to grip and release a line or rope disposed between the drum and one or more of the pads. A hook is horizontally pivoted to the base and normally is spring-urged to hold the release lever against movement relative to the base but can be pulled by a lanyard to free the release lever and the drum thereon to pivot away from the base.

9 Claims, 5 Drawing Figures

FIG_4
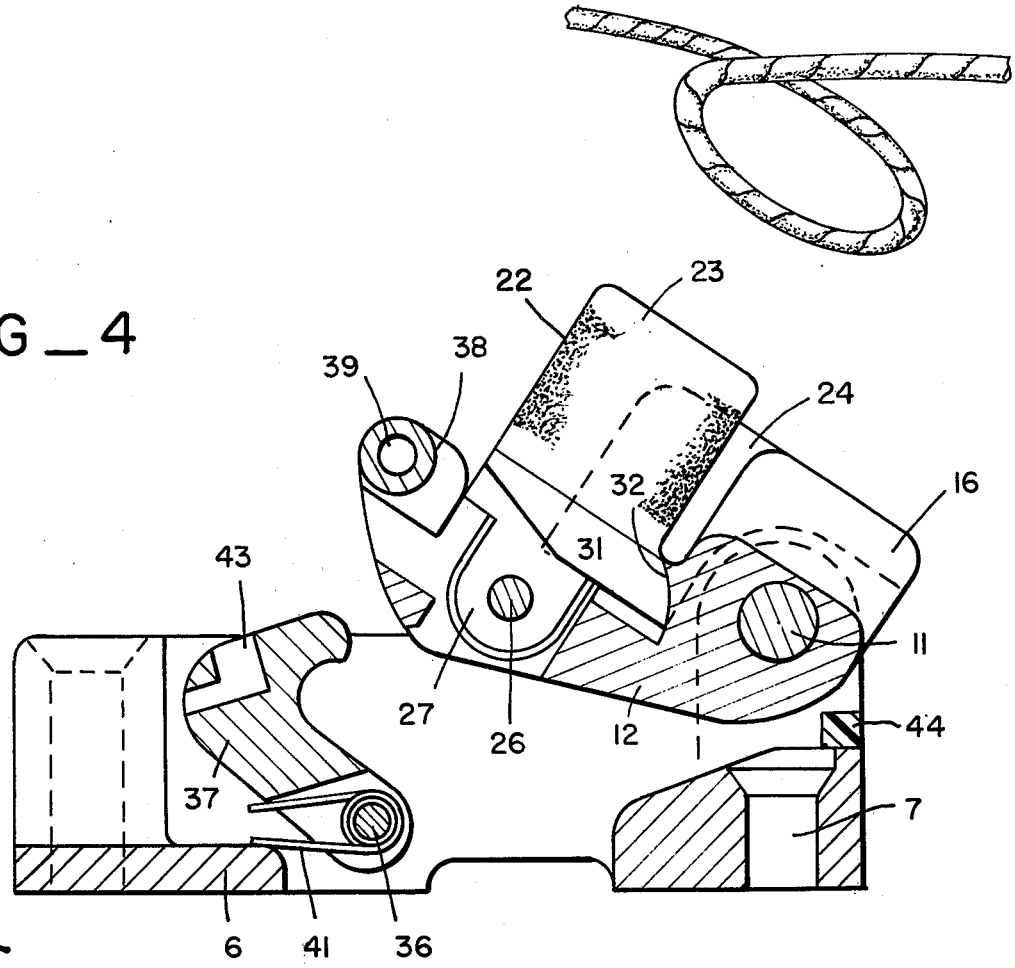
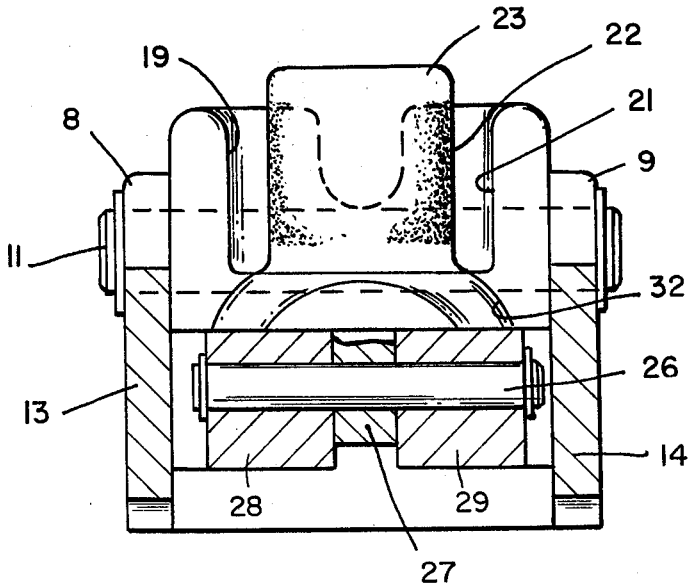
FIG_5

BACKGROUND OF THE INVENTION

In the handling of barge and ship mooring and the like, particularly in connection with maneuvering and tieing up and casting off in a very heavy seas and under adverse conditions, it is difficult to secure a line to the vessel, for example, and it is even more difficult to afford a quick release of the line when it is desired to free the vessel from restraint. In some instances in order to avoid great danger, it is necessary to effectuate an extremely quick release. This has sometimes been accomplished by severing the hawser or line; for example, by an axe, but this is not only wasteful and destructive of the cordage but is accompanied by considerable danger.

It is therefore an object of the invention to provide a bollard that is thoroughly effective in securing a line when that is to be accomplished and is equally effective in affording a controlled and almost instantaneous release of the line when that is to be accomplished.

Another object of the invention is to provide a bollard that is effective in releasing a line without in any way sacrificing or damaging the line itself.

Another object of the invention is to provide a quick-releasing bollard that is effective under adverse conditions of operation and can accommodate lines or hawsers of varying characteristics and sizes.

A further object of the invention is to provide a bollard that is safe to operate and is possessed of great durability and easy maintenance.

A further object of the invention is in general to provide an improved bollard having a quick-release feature.

A further object of the invention is to provide a method of securing a line or hawser to a quick release system without the necessity of splicing an eye or typing a loop in said line.

A further object of the invention is to provide a means of employing a quick release system in any part of a line or hawser.

BRIEF SUMMARY OF THE INVENTION

A normally upright bollard drum is mounted on a lever to move toward and away from upstanding pads on the lever to grip and release a line therebetween. The lever is pivoted on a base and is normally held against pivotal movement by a hook. Release of the hook frees the lever and the bollard drum to pivot bodily on the base to free the line.

BRIEF DESCRIPTION OF THE DRAWING

FIG. 4 is a view comparable to FIG. 2 but showing the parts in released position; and FIG. 5 is a view on the lines 5—5 of FIG. 2.

DESCRIPTION OF THE PREFERRED EMBODIMENTS

Figure 1:
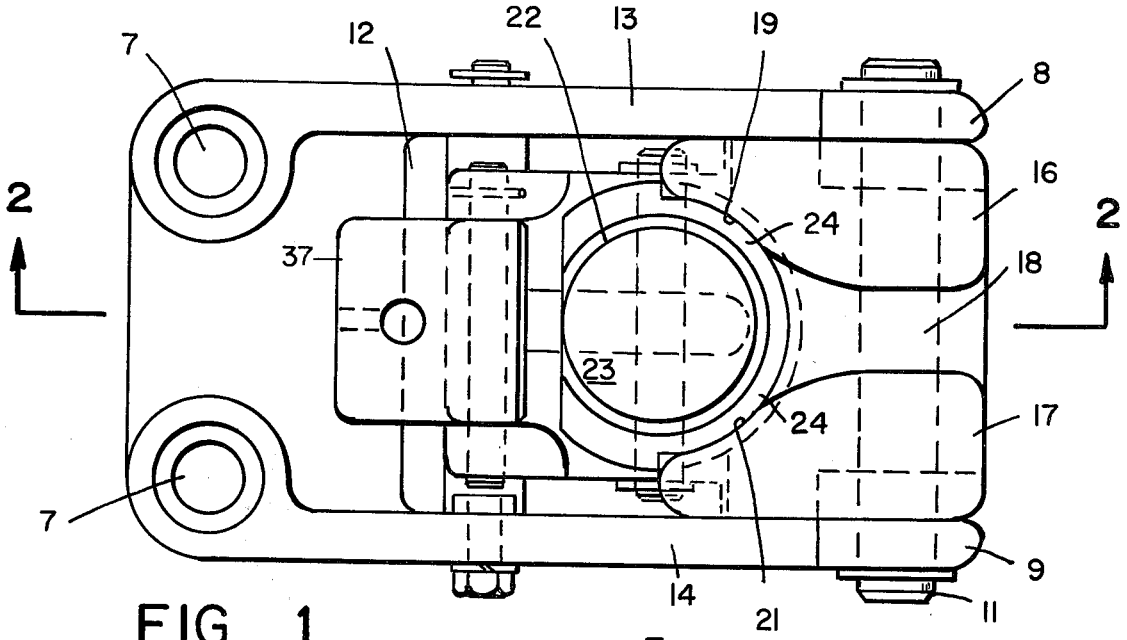
FIG. 1 is a plan of a bollard constructed pursuant to the invention shown in normal holding position but with the lanyard omitted.

While a bollard pursuant to the present invention can be incorporated in a number of different ways, it has with success been incorporated as shown herein. The bollard is designed to include a substantial base 6 such as an extensive casting designed to rest upon and be made fast to any suitable support, not shown, such as a deck or mooring machinery, or the like, and has openings 7 therethrough for the reception of permanent fastenings to secure the bollard base to the deck or supporting machinery in any desired position. The base 6 is so contoured, particularly in the outboard region thereof, as to include a pair of upstanding bosses 8 and 9 in which or through which a cross rod 11 is situated and fastened.

Journalled on the cross rod 11 is a release lever 12 of a generally rectangular plan and designed, in one of its positions, to fit between a pair of upstanding side walls 13 and 14 on the base. The release lever itself has a pair of upstanding pads 16 and 17 spaced apart centrally to define a groove 18 or way for the reception of a line, rope, hawser or cordage from a mooring location. The pads are smoothly diverging away from the groove 18 to establish side walls 19 and 21 extending to face and complement the opposite, circular-cylindrical outer wall 22 of a bollard drum 23. The wall may be roughened.

Figure 2:
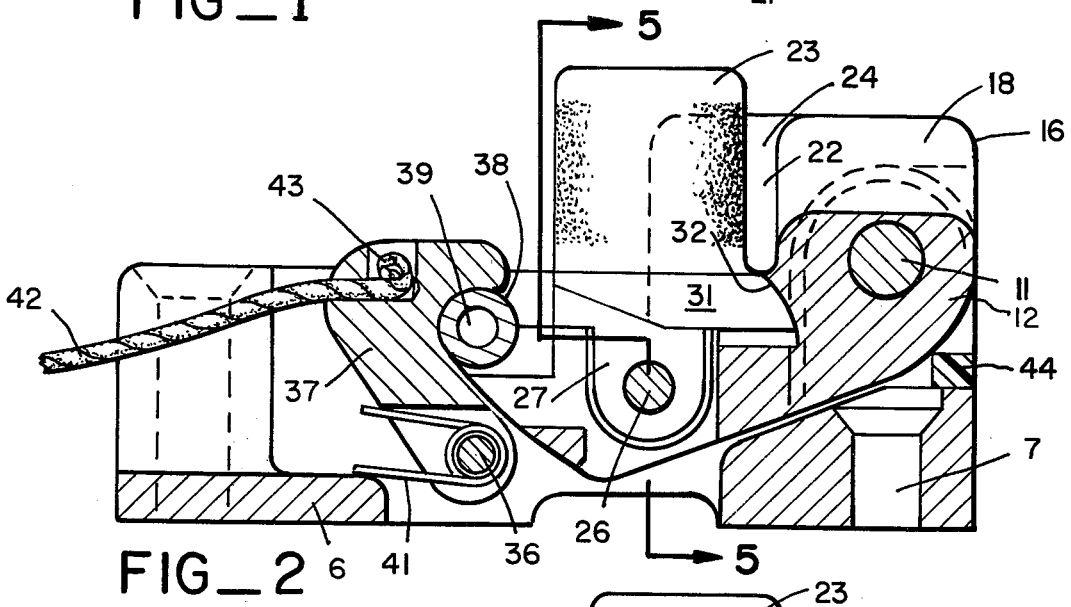
FIG. 2 is a cross-section, the plane of which is primarily on the line 2—2 of FIG. 1.

The drum is generally in an upstanding location and when so positioned defines, as shown in FIG. 2, intervening channels 24 between the outer wall 22 of the bollard and the walls 19 and 21. In effect, the groove 18 extends and divides to afford a pair of arcuate, lateral channels. The bollard drum is mounted on the release lever 12 by means of a cross bar 26 passing through a central depending lug 27 on the bollard drum and also passing through side portions 28 and 29 (FIG. 5) of the release lever, the arrangement being such that the bollard drum is able to pivot on the release lever, there being clearance of generous amount between the bollard bottom and the lever. In turn, the lever is able to pivot on and with respect to the base.

In order that there always be a smooth bottom without any pinch effect for the channel 24, the cylindrical portion of the bollard drum merges near its base with an extension 31 having a generally spherical surface. In one position the extension 31 lies within a spherically surfaced undercut groove 32 in the release lever. The extension 31 is interrupted in the forward portion of the bollard mechanism.

To hold the release lever normally in position as shown in FIG. 2, the base has an additional rod 36 extending between its sides and also carrying the central portion of a securing hook 37 or lever pivotally engaged therewith. The securing hook in one position overlies and engages a roller 38 mounted on a cross rod 39 spanning the sides of the release lever. A spring 41 engages the base 6 and also a part of the securing lever and normally urges the securing lever into a position in engagement with the roller 38 to hold the bollard drum in secured position. A lanyard 42 extends from anchor passages 43 in the securing lever. A hydraulically actuated plunger or the like, or electrical release, may be used but the lanyard is representative.

Figure 3:
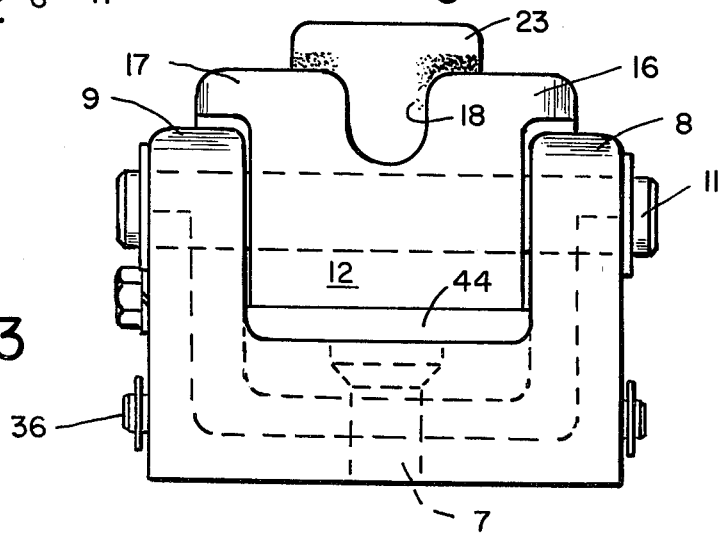
FIG. 3 is an end evaluation of the bollard.

In the normal mooring position of the parts, as shown in FIGS. 1, 2, and 3, for example, a line or hawser is brought in through the way or groove 18, passes through a part of the channel 24 adjacent the wall 19, for example, passes around the bollard drum 23 and then is tucked under the incoming hawser and passes around the drum one or more turns according to the line size or charateristics and finally leads off through a portion of the channel 24. The arrangement is such that tension on the line so disposed tends to pull against the bollard drum and to pinch or nip the line between the surface of the rockable or movable bollard drum and the adjacent surfaces of the walls 19 and 21, thus affording an extremely secure mooring despite variations in the size or nature of the line.

When it is desired to release the line, it is merely necessary to pull on the lanyard 42. This rocks the securing lever 37 to a release position, toward the left as shown in FIG. 2, tensioning the spring 41 but removing the restraint of the securing lever from the roller 38. The horizontal pull on the bollard drum, being substantially above the pivotal axis of the rod 11, then moves both the bollard drum and the lever in a clockwise direction, as seen in FIG. 2, and into and through the position of the parts shown in FIG. 4.

Since the bollard drum is no longer restrained, it swings upwardly as far as is necessary with the lever and actually rocks or rotates bodily clockwise about the shaft 11 but is free to lead or lag due to its mass and to rock within limits around the rod 26. The pinch or nip on the line is quickly relieved and permits the bight and the entire line to fly off the bollard drum as shown in FIG. 4. This operation is substantially instantaneous. The general tendency of the bollard drum and lever is to continue to rotate to the right, as shown in FIG. 4, until a stop portion of the release lever strikes a urethane bumper 44 on the base 6. The rebound tends to move the entire assembly back into the FIG. 2 position. Provided the attendant has released the lanyard 42 in the meantime, the securing hook snaps back into place to retain the repositioned release lever. The device is then ready for a subsequent mooring and releasing operation.

With this arrangement, since the bollard drum is movable with respect to the release lever, not only is the line properly secured or nipped when the bollard is held by the securing lever 37, but also there is an immediate and quick motion of the bollard into a line releasing position and into a position for the bight of the line freely to come off the bollard drum.

What is claimed is:

1. A bollard comprising a base, a release lever, first means for pivoting said release lever on said base, a bollard drum, second means for pivoting said bollard drum on said release lever, and releasable means for securing said release lever to said base.

2. A device as in claim 1 in which said first means and said second means operate about parallel axes.

3. A device as in claim 1 in which said second means is located between said first means and said releasable means.

4. A device as in claim 1 in which said releasable means includes a latch lever movable into and out of position interengaging said release lever and said base.

5. A device as in claim 4 including means for biasing said latch lever into said interengaging position.

6. A device as in claim 1 in which said release lever includes at least one pad having a wall opposite to and concentric with said bollard drum and spaced therefrom to define one side of an intervening line channel.

7. A device as in claim 6 in which said release lever includes a second pad having a wall opposite to and concentric with said bollard drum and spaced therefrom to define another side of an intervening line channel.

8. A device as in claim 7 in which said pads are spaced apart and contoured to define a line groove between them.

9. A device as in claim 1 including stop means for limiting pivotal movement of said bollard drum on said lever.

* * * * *